United States Patent [19]

Edstrom et al.

[11] Patent Number: 4,684,277

[45] Date of Patent: Aug. 4, 1987

[54] APPARATUS FOR DELAYING PRINTER BAIL CLOSING

[75] Inventors: Carl W. Edstrom, Canoga Park; Daniel E. Fedele, Simi; Martin Lazar, Canoga Park, all of Calif.

[73] Assignee: Raytheon Company, Lexington, Mass.

[21] Appl. No.: 454,947

[22] Filed: Jan. 3, 1983

Related U.S. Application Data

[63] Continuation of Ser. No. 210,953, Nov. 28, 1980, abandoned.

[51] Int. Cl.[4] ..... B41J 13/20

[52] U.S. Cl. ..... 400/639.1; 400/624

[58] Field of Search ..... 400/146, 582, 639.1, 400/639.2, 636, 636.1, 636.2

[56] References Cited

U.S. PATENT DOCUMENTS

| | | | |
|---|---|---|---|
| 1,052,021 | 2/1913 | Steele | 400/639.1 X |
| 2,210,168 | 8/1940 | Hart | 400/639.2 X |
| 3,157,266 | 11/1964 | Dollenmayer | 400/639.1 X |
| 3,266,612 | 8/1966 | Kittel et al. | 400/636 X |
| 4,031,995 | 6/1977 | Blum et al. | 400/639.1 X |
| 4,091,912 | 5/1978 | Moss | 400/146 |
| 4,101,018 | 7/1978 | Sokolowski | 400/582 |
| 4,273,456 | 6/1981 | Bisczat et al. | 400/639.1 X |

OTHER PUBLICATIONS

IBM Technical Disclosure Bulletin, "Automatic Mechanical Paper Bail Closer", Roy et al, vol. 22, No. 6, Nov., 1979, pp. 2173-2174.

*Primary Examiner*—Ernest T. Wright, Jr.
*Attorney, Agent, or Firm*—William R. Clark; Richard M. Sharkansky

[57] ABSTRACT

An apparatus for delaying the closing of a printer paper bail so that paper positioned for the first line of printing at the top of the paper will advance in the paper path to a position where the paper bail can close on it. The apparatus mounts on a conventional paper bail assembly and has a sector cam which rotates to a position between its axis of rotation and the platen thereby restraining the closing of the paper bail. It is preferable that the sector cam contact the drive gear of the platen. When the platen rotates for feeding the paper through the paper path, frictional contact between the sector cam and the platen gear causes the sector cam to rotate to a position where the sector is no longer between its axis of rotation and the platen thereby permitting the paper bail which is under spring tension to close.

6 Claims, 8 Drawing Figures

APPARATUS FOR DELAYING PRINTER BAIL CLOSING

CROSS-REFERENCE TO RELATED CASES

This is a continuation of application Ser. No. 210,953, filed Nov. 28, 1980, now abandoned.

BACKGROUND OF THE INVENTION

In today's business world, there are a variety of printers in widespread usage. These commercially available printers are generally used as output devices for digital processors such as, for example, word processors. A substantial number of these printers are impact printers which, as defined herein, is a printer having a molded character which impacts a ribbon which makes contact with the paper. As is well known in the art, the print quality is optimized when the paper is secured against a firm surface. Accordingly, most of the printers utilize conventional typewriter paper path parts comprising a platen roller, guide plate, feed rollers and paper bail roller assembly. Generally, a movable carriage assembly is used so that the platen is stationary. Many of the carriage assemblies have a daisy print wheel whereby the molded characters are at the ends of spokes which fan out from a hub. Also, many printers use bi-directional printing which means they print when the carriage assembly is moving in both directions.

Because speed and operator convenience are important operational parameters for printers, many automatic paper feed mechanisms have been introduced to the marketplace. One of these commercially available paper feeders will be described, but it is understood that the description or a slight deviation from it will be applicable to many other automatic paper feeders. The paper feeder mounts on the top of the printer and a mechanical arm from the feeder is connected to the paper bail roller assembly. When a sheet of paper is to be fed into the printer, the paper feeder feeds a sheet of paper into the paper path of the printer until it reaches the position where the platen roller contacts the first row of feed rollers. Simultaneous to or immediately after this action, the paper feeder opens the paper bail assembly by activating a solenoid which controls the mechanical arm. Then, the paper feeder provides a series of line feeds to the printer, which sequence advances the paper through the paper path to a typing position which is approximately one inch below the top of the paper. Next, the solenoid is deactivated and a spring in the paper feeder causes the mechanical arm to retract so as to close the paper bail assembly on the paper. After completion of printing on that sheet of paper, the paper feeder controls the ejection of the paper and the automatic insertion of a new sheet of paper as previously described. In a typical office scenario for a word processor application, the operator types a page of text into the word processor and depresses the PRINT key to initiate the printing process. Frequently, the printer and paper feeder are enclosed in a sound shield to reduce the noise in the environment. When the printing on a sheet of paper is completed, the sheet of paper is automatically ejected and a new sheet of paper is fed into position with the paper bail assembly being opened and closed at appropriate times. Without opening the sound shield, the operator may then continue to type the next page of text and at some later time repeat the printing process.

It was found that there are circumstances where it is desirable to have the first line of text at the top of the paper instead of down approximately one inch. To provide this feature, the paper feeder was modified so that a fewer number of line feeds were transferred to the printer for advancing the paper through the paper path during automatic feed; this advanced the paper only to a position where the first line of text was at the top of the paper. However, it was determined that if the paper bail assembly was closed with the paper at this position, the paper would jam when it fed up to the paper bail assembly position during printing. Furthermore, because it may be an extended period of time before the next PRINT function is executed as described above in a typical operational scenario, it was undesirable to electronically delay the closing of the paper bail assembly until several lines of text had been printed. To delay deactivation of the solenoid, the power supply for the unit would have to be larger to maintain activation of the solenoid simultaneous to other functions. Also, a large amount of power would be consumed by the power supply. Further, the deactivation of the solenoid during the printing cycle could cause power spikes and interference which would adversely affect the printing.

SUMMARY OF THE INVENTION

The invention discloses an apparatus for holding a recording media in a secure position for performing recording operations thereon comprising an elongated roller, a U-shaped member having its legs pivotally mounted for rotational movement from an axis parallel with the roller, the movement being between a closed position wherein the cross connecting section of the member is in rolling contact with the roller and an open position wherein the cross connecting section is spaced from the roller, means for urging the member towards its closed position, and means for restraining the movement of the member towards the closed position until the roller rotates through an arc. It may be preferable that the member define a paper bail for a printing apparatus as is known conventionally. Generally, the legs are mounted from pins extending from the frame; the cross connecting section is generally the bail bar which in all rotational positions is parallel to the roller and has small rollers mounted thereon which make contact with the platen in its closed position. The roller preferably is the platen of a conventional printing apparatus. Also, it is preferable that the urging means comprise a spring tensioned to close the member in contact with the roller. Furthermore, it may be preferable that the restraining means comprise a rotatable sector cam connected to one leg of the U-shaped member between the rotational axis of the member and the cross connecting section. Furthermore, it is preferable that the restraining means comprises means for urging the sector cam towards a rotational position between the rotational axis of the member and the roller. Typically, the recording media would be paper.

The invention also discloses a printing apparatus comprising a rotatable platen, a paper bail pivotally mounted as is conventional for movement through an arc between a closed position in rolling contact with the platen and an open position spaced from the platen, and means coupled to the bail for restraining motion of the bail in a direction towards the closed position until the platen rotates through an arc. The arc is generally the distance that the paper advances in the paper path before the restraining means becomes nonfunctional and permits the bail to close. The advancement of paper corresponding to the arc may be preferable in certain applications to permit the paper to advance from a starting position to where it is between the bail and the platen so that the bail can be closed on it. It may be preferable that the restraining means comprise a rotatable sector cam having a rotational axis parallel with the platen. Also, it may be preferable that the restraining means further comprise means for urging rotation of the sector cam to a position wherein the sector of the sector cam is between the axis of rotation of the cam and the platen. Also, it may be preferable that the apparatus further comprise means for urging the paper bail towards a closed position providing frictional contact between the sector and the platen when the sector is between the axis of rotation of the sector cam and the platen.

The invention also teaches a printing apparatus comprising a rotatable platen, a paper bail pivotally mounted for movement between a closed position in rolling contact with the platen and an open position spaced from the platen, and means responsive to rotation of the platen for delaying the closing of the bail until the platen has rotated for a plurality of line feeds. The delaying means may be considered analogous to the restraining means defined earlier herein. The line feeds are used to advance the paper during printing and the delay is preferable so that a sheet of paper having printing starting at the top of the paper will advance to a position between the bail and the platen so that the bail can be closed on it.

Also, the invention may be taught by an apparatus for restraining the closing of a paper bail urged against a platen until paper in the paper path has advanced to a position between the bail and the platen, comprising a sector cam rotatably connected to the bail, the rotational axis of the cam and the platen being parallel, and means for urging the sector of the sector cam towards a rotational position between the rotational axis of the cam and the platen for restraining the closing of the bail by contact with said platen until the frictional rotational torque on the cam by rotation of the platen for advancement of paper causes the cam to rotate until the sector is not between the rotational axis of the cam and the platen. It is preferable that the urging means comprises a spring and more preferably that it comprise an over center spring.

BRIEF DESCRIPTION OF THE DRAWING

The invention and its advantages will be more fully understood by reading the description of the preferred embodiment with reference to the drawing wherein.

DESCRIPTION OF THE PREFERRED EMBODIMENT

Figure 1:
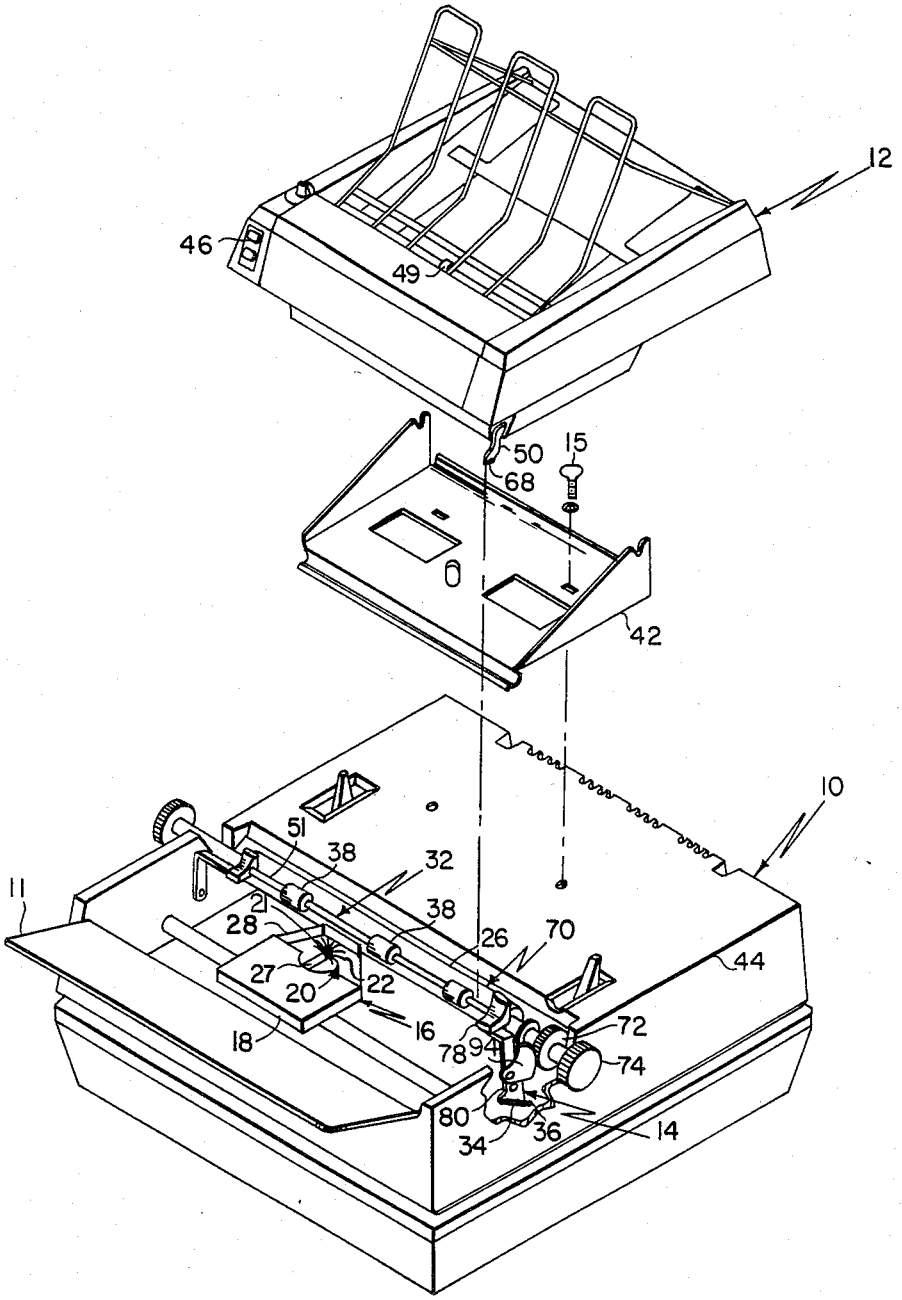
FIG. 1 is a perspective view of a printer embodying the invention and automatic paper feeder.
Figure 2A:
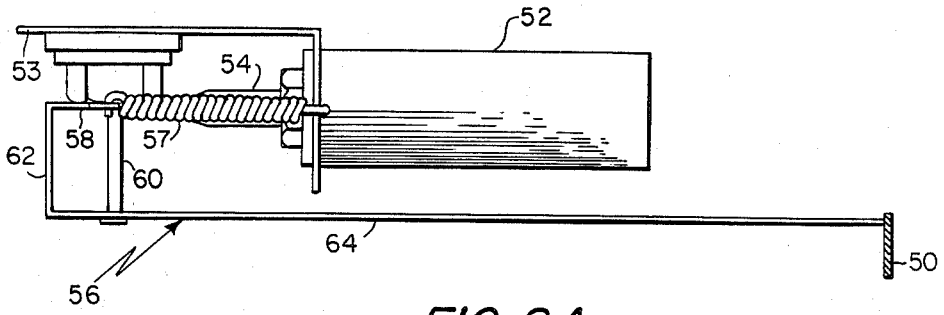
FIGS. 2A and 2B respectively show a conventional apparatus which is part of the paper feeder of FIG. 1 and which opens and closes the paper bail assembly of the printer.
Figure 2B:
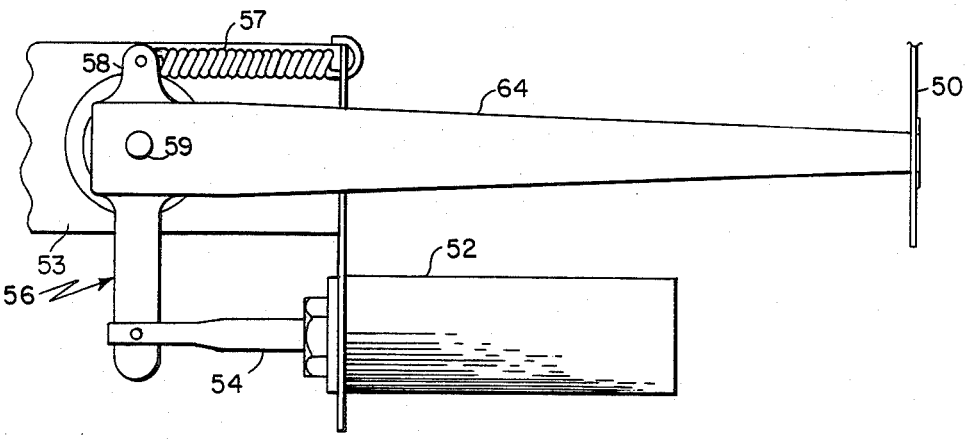
Figure 5:
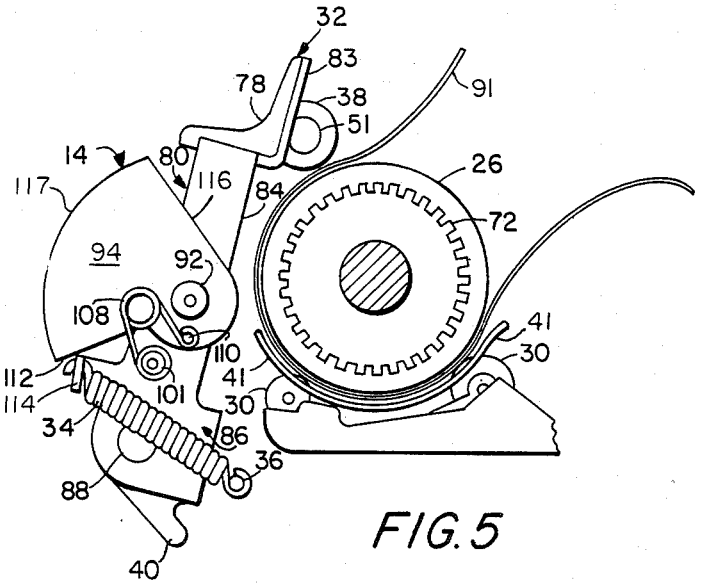
FIG. 5, 6 and 7 are respective views taken along lines 5—5, 6—6, and 7—7 of FIG. 3, which views show the bail restraining apparatus in three different operational positions.
Figure 6:
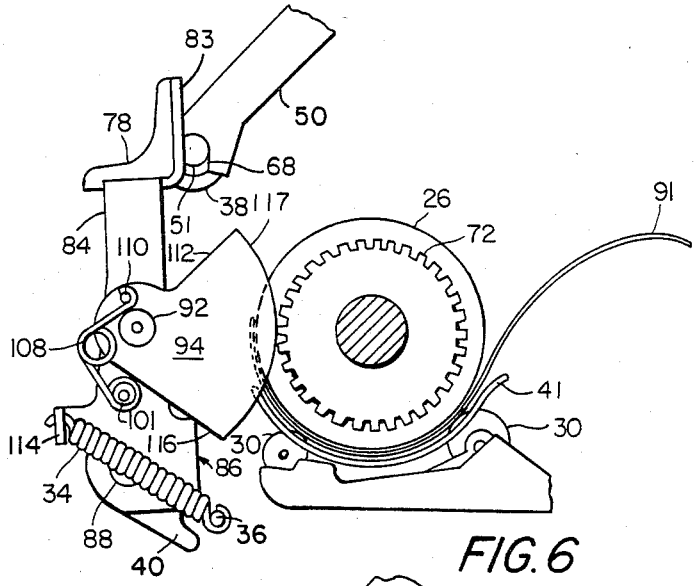
Figure 7:
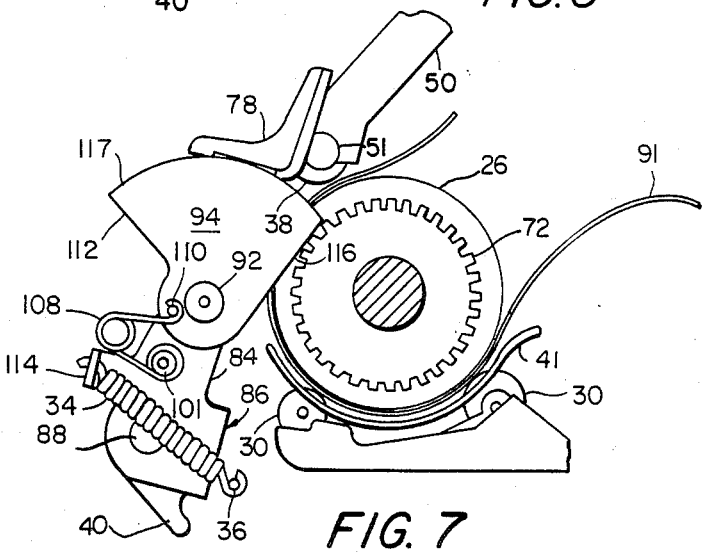

Referring to FIG. 1, there is shown a partially cutaway view of printer 10 with paper feeder 12 and mounting tray 42 spaced thereabove. As is well known, mounting tray 42 may be connected to printer 10 using suitable means such as screw 15. Paper feeder 12 is then seated on mounting tray 42 and automatically feeds paper 91 into printer 10 such as shown in FIGS. 5, 6, and 7. Front cover 11 of printer 10 is in the opened position.

Still referring to FIG. 1, a printer 10 suitable for use according to the invention may preferably be remotely controlled by digital control signals and character codes such as, for example, a Model No. S3/55 Sprint III Printer manufactured by Qume Corporation of San Jose, California. Printer 10 has a movable printer carriage 16 that comprises a snap in ribbon cartridge 18 and a replaceable print wheel 20 commonly referred to as a daisy print wheel. More specifically, the print wheel 20 has 96 spokes 22 which fan out from the hub 21 of the print wheel 20. The tip of each spoke 22 is molded in the form of an alphanumeric character. The print wheel 20 rotates in the vertical plane. The position of the print wheel 20 is such that the spoke 22 in the 12 o'clock position receives the impact of the print hammer 27. When the print hammer 27 flies forward and strikes the flexible spoke 22 squarely, the molded character impacts on the ribbon 28 which has been raised. In other words, character selection is determined by the angular position of the print wheel 20 at the instant the print hammer 27 is activated. The movable printer carriage 16 prints bi-directionally which means it prints while moving in both of its horizontal directions.

The area of the paper 91 on which the printing is effected by the impact of the ribbon 28 is firmly positioned against the platen roller 26 by the combination of the paper guide feed rollers 30 and the paper bail 32. As is conventional, paper bail 32 is mounted on pins 88 at the two sides of the printer 10 so that it may be rotated through an arc between opened and closed positions about platen roller 26. Spring 34 is attached from the paper bail 32 to rod 36 extending from the frame 37 of the printer 10. The possible rotational arc of the paper bail 32 is determined in one direction by the position where the bail rollers 38 contact the platen roller 26 and in the other direction by a finger 40 of the paper bail 32 that contacts bar 36. In a position within the possible rotational arc of paper bail 32, spring 34 passes through the rotational axis of the paper bail 32 as is best illustrated in FIG. 6. Accordingly, when the paper bail is moved in the forward direction from that position, spring 34 applies a force to the paper bail 32 which urges it toward the closed position where it firmly secures the paper 91 between bail rollers 38 and platen roller 26. Conversely, if the paper bail 32 is moved in a backward direction from that position, spring 34 urges the bail 32 to an open position. As is well known, the reason for having the open position for the paper bail 32 is so the paper 91 can be inserted between it and the platen roller 26.

The printing line on the paper 91 is changed by rotating platen roller 26. Feed rollers 30 provide friction between platen roller 26 and the paper 91 therebetween on the bottom of platen roller 26. Paper guide plate 41 defines the general paper path below platen roller 26.

Again referring to FIG. 1, paper feeder 12 suitable for use in association with printer 10 may preferably be controlled by digital signals routed from printer 10 such as, for example, a Model No 81600 Sprint III Speed Feed manufactured by Qome Corporation of San Jose, Ca. Mounting tray 42 is attached to the cover 44 of printer 10 and paper feeder 12 is thereby supported.

In operation, the first page of paper 91 is generally fed from the paper feeder 12 into the printer 10 in response to depressing feed switch 46 of the paper feeder 12. Then, after the printing of a page is completed in response to a PRINT command, the paper 91 is ejected and paper feeder 12 automatically injects a new sheet of paper 91 into printer 10.

To inject a new sheet of paper 91 into printer 10, roller 49 in the paper feeder 12 directs the top sheet of a stack of paper 91 downward from the paper feeder 12 until it contacts the junction between platen roller 26 and the back row of paper guide feed rollers 30. Paper feeder 12 then provides a series of control signals to printer 10 to rotate platen roller 26 and advance the paper 91 through the guide path. Paper feeder 12 also opens paper bail 32 of printer 10 so that the paper 91 may be fed between it and platen roller 26. Bail lift arm 50 which engages the bar 51 of paper bail 32 extends from the paper feeder 12 to open the paper bail 32.

Referring to FIGS. *2a* and *2b*, there are side and bottom views of the bail lift assembly 56 which is included in paper feeder 12 and functions to open the paper bail 32. When the paper bail 32 of the printer 10 is to be opened, solenoid 52 is activated and plunger 54 recedes into the solenoid 52. Bail lift assembly 56 comprises pivot base 58 connected at one end to plunger 54 and at the other end to spring 57. Pivot base 58 has a hole 59 in the interior which is inserted over pin 60 connected to the frame 53 of feeder 12. The force exerted on pivot base 58 by plunger 54 when solenoid 52 is activated is sufficient to cause rotation of pivot base 58 axially about pin 60 against the resistance of spring 57 of the paper feeder 12 and spring 34 of the printer 10. Bail lift assembly 56 also comprises a section 62 perpendicular to pivot base 58 and extender arm 64 which is perpendicular to section 62. Rotation axial to pin 60 causes the end of extender arm 64 to move from 0.5 to 0.62 inches in a horizontal plane. Bail lift arm 50 is connected to extender arm 64 and has a groove 68 for coupling to paper bail 32. In operation, when the paper bail 32 is to be opened, solenoid 52 is activated and bail lift arm 50 extends from feeder 12 forcing the paper bail 32 open. When the paper bail 32 is to be closed, solenoid 52 is deactivated and spring 57 exerts a force to rotate bail lift assembly 56 in the opposite direction retracting the bail lift arm 50. As described earlier herein, the printer 10 and paper feeder 12 described heretofore are commercially available and well known in the art. With the paper feeder 12 so described, enough line feeds are transferred to the printer 10 to advance injecting paper 91 through the open paper bail 32 to a position where the first typed line is approximately one inch down from the top of the page. At that time, solenoid 52 in feeder 12 is deactivated to close the paper bail 32 on the paper 91.

Figure 4:
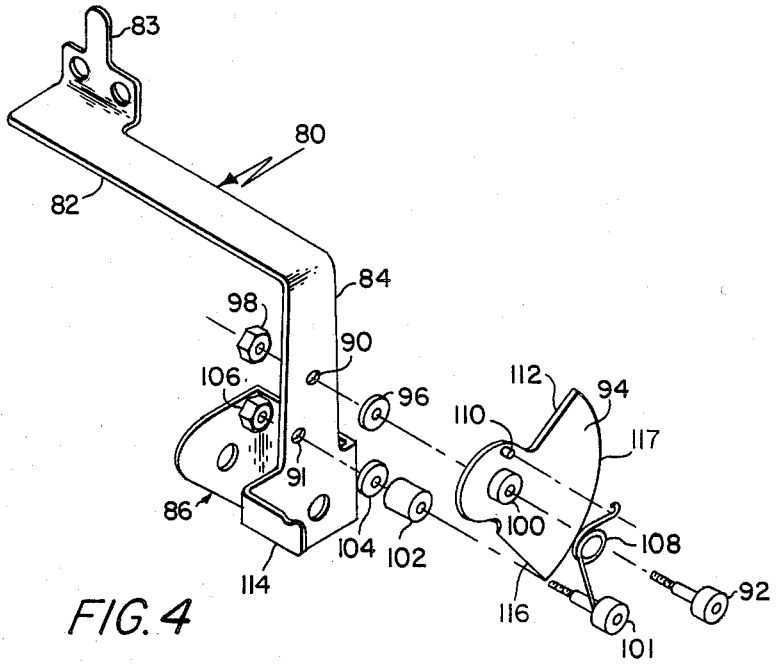
FIG. 4 is a perspective view of the mounting of the bail restraining apparatus on a conventional paper bail.
Figure 3:
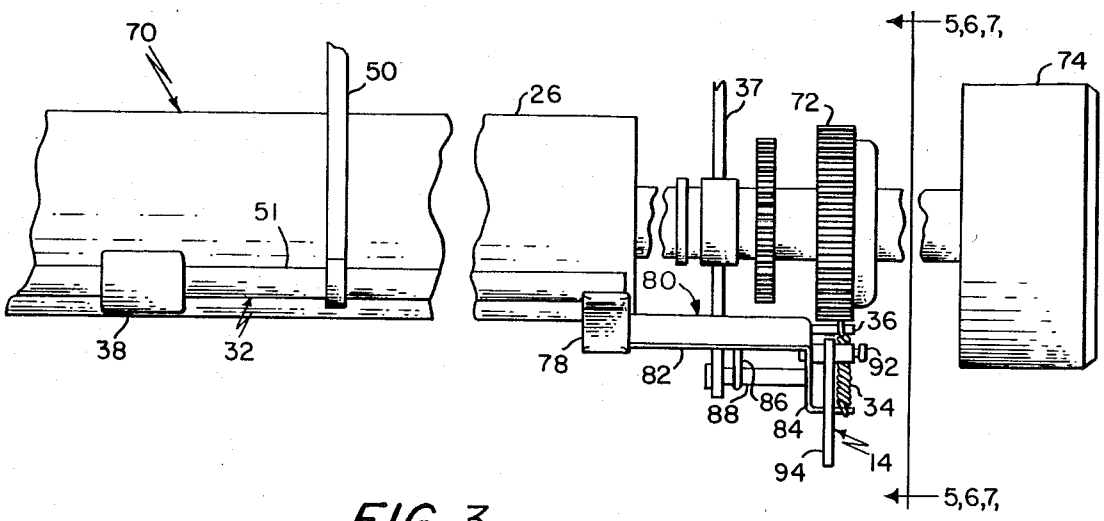
FIG. 3 is a top view of the platen, bail and bail restraining apparatus.

Referring to FIG. 3, there is shown a top view of platen assembly 70, paper bail 32, and paper bail restraining assembly 14. Platen assembly 70 comprises platen roller 26, platen gear 72 and platen knob 74. A gear (not shown) couples with platen gear 72 to rotate platen assembly 70 and thereby advance paper 91 in the paper path. Paper bail 32 comprises rollers 38 which contact platen roller 26 in the closed position, bar 51, plastic handle 78 and mounting bracket 80. The shape of mounting bracket 80 is shown in FIG. 4 wherein there is a horizontal member 82 with a raised portion 83 for securing bar 51 on one side to plastic handle 78 on the other side. A vertical member 84 is formed by a bend from horizontal member 82 and a bottom support structure 86 permits mounting bracket 80 to rotate on pin 88.

Still referring to FIG. 4 and also to FIGS. 3, 5, 6 and 7 where appropriate, the modification of mounting bracket 80 for installation of bail restraining assembly 14 onto conventional paper bail 32 is shown. More specifically, holes 90 and 91 are made into vertical member 84 of mounting bracket 80. Shoulder screw 92 is inserted through sector cam 94, washer 96, hole 90 and is secured by nut 98. Sector cam 94 is coupled to disk 100 and the two are rotatable on shoulder screw 92. Shoulder screw 101 inserts through spacer disk 102, washer 104, hole 91 and is secured by nut 106. Over center spring 108 is connected on one end to shoulder screw 101 and on the other end to protrusion 110 from sector cam 94.

Referring to FIGS. 3 and 5, two views, one top and one side, are shown of bail restraining assembly 14 in an out-of-service position. Typically, this position would be used when the automatic paper feeder 12 is not being used; in FIG. 5, bail lift arm 50 is not connected. Sector cam 94, as viewed in FIG. 5, is manually rotated in a counter-clockwise direction. In this position, over center spring 108 exerts a force on protrusion 110 that creates a torque on sector cam 94 that urges it in a counter clockwise direction. Rotation in the counter-clockwise direction is eventually blocked when edge 112 contacts mount 114 of spring 34. Edge 112 runs approximately along a radius from hole 90 which is the rotation axis of sector cam 94 so that the sector cam 94 may be moved to this out-of-service position without contacting shoulder screw 101. In the out-of-service position, paper bail restraining assembly 14 has no effect on the operation of printer 10. More specifically, it does not determine whether the paper bail 32 can move forward to the closed position.

Referring next to FIG. 6, one of the in-service positions of bail restraining assembly 14 is shown. From the out-of-service position of FIG. 5, and with the paper bail 32 open, sector cam 94 is manually rotated in a clockwise direction. At a particular position in the rotation, the moment arm exerted by over center spring 108 on protrusion 110 passes through the rotational axis of sector cam 94. After that position, which is defined as the in-service state of the bail restraining assembly 14, a clockwise torque is exerted on sector cam 94 urging it towards the rotation limit where edge 116 would contact shoulder screw 101; it may be preferable that the torque of over center spring 108 cease just prior to edge 116 contacting shoulder screw 101. When solenoid 52 is not activated, bail lift arm 50 exerts a force on paper bail 32 as a result of spring 57, which force urges the paper bail 32 towards a closed position. The paper bail 32 and bail restraining assembly 14 move in that direction until restrained by edge 117 of sector cam 94 contacting platen gear 72. Accordingly, at that time of the operation, the paper bail 32 remains part way open. As text is printed by printer 10 causing platen roller 26 and platen gear 72 to rotate in a clockwise direction in order to advance the printing line, platen gear 72 exerts a frictional counter clockwise torque on sector cam 94.

Because the torque is large enough to overcome the torque exerted by over center spring 108, sector cam 94 rotates in a counter clockwise direction until edge 116 becomes tangential to platen gear 72. At this position, sector cam 94 no longer functions to restrain the forces of springs 34 and 57 and the paper bail 32 moves forward to the closed position. FIG. 7 shows bail restraining assembly 14 in this second depicted in-service position. As shown in FIG. 7, as platen roller 26 and platen gear 72 continue to rotate clockwise to advance the paper 91 during the printing process, bail restraining assembly 14 has no operational impact on paper bail 32 being closed to secure the paper 91. When the page is ejected after printing and a new page is to be inserted into the printer 10 as described earlier herein, bail lift arm 50 in response to solenoid 52 exerts a force that opens the paper bail 32. At this time, the clockwise torque exerted by over center spring 108 causes sector cam 94 to rotate in that direction. Then, when solenoid 52 is deactivated and a force exerted to close the paper bail 32, it moves forward until sector cam 94 contacts platen gear 72 as shown in FIG. 6. Once again, in sequence, bail restraining assembly 14 mechanically delays the closing of paper bail 32 until a plurality of line feeds have been executed by the printer 10. Accordingly, paper feeder 12 may be modified by techniques well known in the art to provide only enough line feeds to the printer 10 during the paper injection process so that the paper 91 is advanced to a position where the first printed line is at the top of the paper 91 rather than down approximately one inch as was done in the prior art. The mechanical delay in closing the paper bail 32 in response to the rotation of the platen gear 72 which corresponds to line advancement on the paper 91 permits solenoid 52 to be activated for only a relatively short period of time and the paper bail 32 to remain open until the paper 91 advances between it and the platen roller 26.

It has been found preferable that edge 117 define an arc from a center which is the rotational axis of sector cam 94. The length of the contact arc of sector cam 94 and platen gear 72 between positions defined by FIGS. 6 and 7 in part determines the number of lines the paper 91 is advanced before paper bail 32 closes. The length of the contact arc may be altered by selecting a sector cam 94 or similar rotatable shape having a different radius or a different angle of contact. For the commercially available printer 10 described in the embodiment of FIG. 1, it was found desirable that the radius be slightly greater than one inch. With this dimension, the contact arc between sector cam 94 and platen gear 72 was slightly less than one inch. Because the platen roller 26 has a larger diameter than the platen gear 72, an inch or more of paper 91 advances before the paper bail 32 closes. In an alternate embodiment, edge 116 can be notched and the position of protrusion 110 altered so that sector cam 94 could be rotated further in a clockwise direction before contacting shoulder screw 101 thus increasing the contact arc length.

Sector cam 94 is fabricated of metal and it was found that there was enough friction between it and platen gear 72 to cause counter clockwise rotation against the torque exerted by over center spring 108. If more friction is desirable, a material such as hard rubber having a greater coefficient of friction than metal can be used to fabricate the entire sector cam 94.

The invention has been described for use with a printer having an automatic paper feeder 12. In such application, the paper bail 32 may be opened by the paper feeder 12 during the paper injection cycle as has been done in the prior art. The invention also provides that the solenoid 52 for holding the paper bail 32 open can be deactivated during the injection cycle even though the new sheet of paper 91 is advanced through the paper path only to a position where the first line of text prints at the top of the page and the paper 91 is not between the paper bail 32 and platen roller 26. Bail restraining assembly 14 delays the closing of the paper bail 32 until a plurality of lines of paper 91 have been fed and the paper 91 has advanced until it is between the paper bail 32 and the platen roller 26. The invention provides for starting the printing at the top of the paper 91 without maintaining activation of the bail solenoid 52 for extended periods of time.

The invention may also be used to advantage in applications not including an automatic paper feeder 12. For example, in a typical business office scenario, the operator opens the paper bail 32, positions a sheet of paper 91 in the printer 10 so that the first line of text prints at the top of the page, provides a PRINT function command, waits until several lines have been printed so that the paper 91 has advanced to a position between the paper bail 32 and platen roller 26, and manually closes the paper bail 32. With the use of the bail restraining assembly 14, the operator can position the paper bail 32 as shown in FIG. 6, and then provide the PRINT function command without further action text. It may be found that in this described configuration with spring 57 of the feeder 12 not exerting a force urging the paper bail 32 towards a closed position, spring 34 may not provide enough force to create sufficient friction between the platen gear 72 and sector cam 94 to rotate sector cam 94 against the torque provided by the over center spring 108. In this case, the force of spring 34 may be increased to urge bail 32 toward a closed position.

This concludes the description of the preferred embodiment. The reading of the description herein by those skilled in the art will lead to many modifications without departing from the spirit and scope of the invention. Accordingly, it is intended that the scope of the invention be limited only by the appended claims.

What is claimed is:

1. A printing apparatus comprising:

a rotatable platen assembly comprising a platen roller and a platen gear;

a paper bail pivotally mounted for movement through an arc between a closed position in rolling contact with said platen roller and an open position spaced from said platen roller; and a rotatable sector cam mounted on said paper bail, said cam having a rotational axis parallel with said platen roller, said sector cam in a first rotational position preventing movement of said paper bail to said closed position, said sector cam rotating by frictional contact with said platen gear to a second rotational position wherein said paper bail moves to said closed position.

2. The apparatus recited in claim 1 further comprising means for urging rotation of said sector cam towards said first rotational position.

3. The apparatus recited in claim 2 further comprising means for urging said paper bail towards said closed position providing said frictional contact between said sector cam and said platen gear when said sector cam is in said first rotational position.

4. An apparatus for restraining the closing of a paper bail urged against a platen roller until paper has advanced to a position between said bail and said platen roller, comprising:

a sector cam rotatably connected to said bail, said cam and said platen roller having parallel rotational axes; and means for urging said sector cam towards a first rotational position between said rotational axis of said cam and said platen roller for preventing the closing of said paper bail by contact with a platen gear connected to said platen roller until the frictional rotation torque on said sector cam by rotation of said platen gear and roller for advancement of paper causes said sector cam to rotate to a second rotational position not preventing the closing of said paper bail.

5. The apparatus recited in claim 4 wherein said urging means comprises a spring.

6. The apparatus recited in claim 5 wherein said spring comprises an over center spring.

* * * * *